US005896619A

United States Patent [19]

Koopman

[11] Patent Number: 5,896,619

[45] Date of Patent: Apr. 27, 1999

[54] REFRIGERATOR DOOR HINGE AND CLOSURE MECHANISM

[75] Inventor: Charles Henry Koopman, Louisville, Ky.

[73] Assignee: General Electric Company, Louisville, Ky.

[21] Appl. No.: 08/920,924

[22] Filed: Aug. 29, 1997

[51] Int. Cl.[6] ..... E05F 3/20; E05F 1/08

[52] U.S. Cl. ..... 16/50; 16/67; 16/68; 16/286

[58] Field of Search ..... 16/50, 66, 67, 16/68, 80, 286, 291, 54, 71, 82

[56] References Cited

U.S. PATENT DOCUMENTS

| | | | |
|---|---|---|---|
| 409,371 | 8/1889 | Pierce | 16/66 |
| 490,886 | 1/1893 | Rock | 16/66 |
| 678,790 | 7/1901 | Nushawg | 16/66 |
| 2,189,818 | 2/1940 | Murrin . | |
| 4,058,170 | 11/1977 | Ankenman et al. | 16/286 |
| 4,690,468 | 9/1987 | Lau . | |
| 5,027,473 | 7/1991 | Hottmann | 16/286 |
| 5,272,789 | 12/1993 | Mitchell et al. . | |
| 5,497,534 | 3/1996 | Caruso . | |
| 5,522,656 | 6/1996 | Jenkins | 16/344 |

*Primary Examiner*—Chuck Y. Mah

*Attorney, Agent, or Firm*—H. Neil Houser

[57] ABSTRACT

A door hinge and closure mechanism which includes a hinge unit and a closure unit is described. The hinge and closure units are integral in that a hinge plate of the hinge unit serves as a support for components of the closure unit. Generally, the closure unit applies a pre-load force on the door when the door is in a closed position. When the door is between a closed position and a neutral force position, the closure unit applies a substantially constant closure force on the door. Once the door is opened beyond a first lock position, the closure unit applies resisting forces to the door when the door which act as a deterrent to further opening of the door. Rather than being expanded during door opening as with known spring closure mechanisms, the spring of the above described closure unit is compressed. Compressing the spring is believed to result in a more smooth and constant closure force on the door, as well as extending the useful life of the spring. Further, a single screw mounts hinge and closure mechanism to the door, which facilitates easy assembly and removal of the door from the cabinet. Also, no component of the mechanism is mounted internally within the door. Rather, all the components are mounted externally of the door, which facilitates avoiding energy loss due to the location of metal parts within the door. The mechanism also provides sufficient closure force so that designed-in rear tilt of the cabinet is unnecessary to ensure proper closure of the door.

19 Claims, 3 Drawing Sheets

REFRIGERATOR DOOR HINGE AND CLOSURE MECHANISM

FIELD OF THE INVENTION

This invention relates generally to household refrigerators and more particularly, to an integral hinge and closure mechanism for a refrigerator door.

BACKGROUND OF THE INVENTION

Side-by-side household refrigerators include a fresh food storage compartment and a freezer storage compartment. Each storage compartment has a front access opening normally closed by a fresh food door and a freezer door, respectively. The doors are mounted to the cabinet by hinge mechanisms. To ensure proper closure of each door, some known refrigerators include closure mechanisms mounted in each door separate from the hinge mechanisms. Such known closure mechanisms include a cam or cams, a spring, and a housing. As the door is opened, the spring expands so that if an operator lets go of the door, the expanded spring draws the door to a closed position.

The above described closure mechanism is difficult to install since it requires access to the interior of the door. In addition, such closure mechanism results in some energy loss due to the metal components, e.g., the spring, mounted within the door. Further, such closure mechanisms sometimes require that the refrigerator be tilted to the rear to provide assistance for door closure.

It would be desirable to provide an easy to install integral hinge and closure mechanism for a refrigerator door. Such an integral mechanism would facilitate reducing the time and costs associated with refrigerator assembly at the factory as well as simplifying the installation of a refrigerator door in a home. It also would be desirable to provide such a mechanism which is not mounted within the refrigerator door to facilitate avoiding energy loss. Further, such mechanism should not be bulky and should provide a smooth constant closure force to close a door from a fully open to a fully closed position, at least for aesthetic reasons. Also, it would be desirable to provide a closure mechanism which does not require that the refrigerator be tilted for assisting in door closure.

SUMMARY OF THE INVENTION

These and other objects may be attained by a door hinge and closure mechanism which, in accordance with one embodiment of the present invention, includes a hinge unit and a closure unit. The hinge and closure units are integral in that a hinge plate of the hinge unit serves as a support for components of the closure unit. The hinge plate is mounted to the door and to the refrigerator cabinet. Particularly, the hinge plate is mounted to the door by a hinge pin, and the hinge plate is mounted to the cabinet by screws which extend through openings in the hinge plate and into threaded engagement with the cabinet. A bushing extends through the hinge pin opening in the hinge plate and facilitates low friction movement of the door relative to the hinge plate. The hinge plate also includes a tab having an opening therethrough, and an offset portion having a link slot therein. The hinge plate is secured in a fixed position relative to the cabinet, and the door may rotate on the hinge pin relative to the hinge plate.

The closure unit includes a pivot plate having a generally u-shape and a spring assembly. The spring assembly is coupled to the pivot plate by a link, which may be a flexible cable. More particularly, the pivot plate is secured to the door by a screw which extends through a first opening in the pivot plate. The screw extends through a bore of a bushing which is trapped between the pivot plate and the door. The link extends through a second opening in the pivot plate. The pivot plate generally travels with the door.

The spring assembly includes an elongate spring housing and a compression spring located within the housing. The link extends through the spring and a stop washer, and one end of the link is crimped to prevent the link from being pulled through the washer towards the door. The spring housing abuts against the hinge plate tab, and the spring assembly may move angularly with respect to the hinge plate tab depending upon the forces acting on the spring assembly due to the position of the door.

Generally, the closure unit applies a pre-load force on the door when the door is in a closed position. When the door is between a closed position and an open, neutral force, position, the closure unit applies a substantially constant closure force on the door. As the door is opened from the fully closed position, the spring assembly may move angularly relative to the tab so that when the door reaches the neutral force position, the spring, the link, and the hinge pin are substantially aligned. Such alignment provides that the closure unit does not draw the door toward a more closed or more open position. Once the door is opened beyond a first lock position, the closure unit applies resisting forces to the door which act as a deterrent to further opening of the door.

Rather than being expanded during door opening as with known spring closure mechanisms, the spring of the above described closure unit is compressed. Compressing the spring is believed to result in a more smooth and constant closure force on the door, as well as extending the useful life of the spring. Further, a single screw mounts the hinge and closure mechanism to the door, which facilitates easy assembly and removal of the door from the cabinet. Also, no component of the mechanism is mounted internally within the door. Rather, all the components are mounted externally of the door, which facilitates avoiding energy loss due to the location of metal parts within the door. The mechanism also provides sufficient closure force so that designed-in rear tilt of the cabinet is unnecessary to ensure proper closure of the door.

DETAILED DESCRIPTION

An exemplary embodiment of a door hinge and closure mechanism in accordance with one embodiment of the present invention is described below in detail in connection with a side-by-side household refrigerator. Side-by-side household refrigerators are commercially available from General Electric Company, Louisville, Ky., 40225, and such refrigerators can be modified to incorporate the hinge and closure mechanism. The hinge and closure mechanism, of course, can be used in many other models and types of refrigerators, such as top mount refrigerators, other than the specific side-by-side refrigerator described herein.

Although the present hinge and closure mechanism is described herein as being coupled to the top of the cabinet, it should be understood that such mechanisms could be coupled to the bottom of the cabinet. The manner of coupling the mechanisms to the bottom of the cabinet will be apparent to those skilled in the art.

Figure 1:
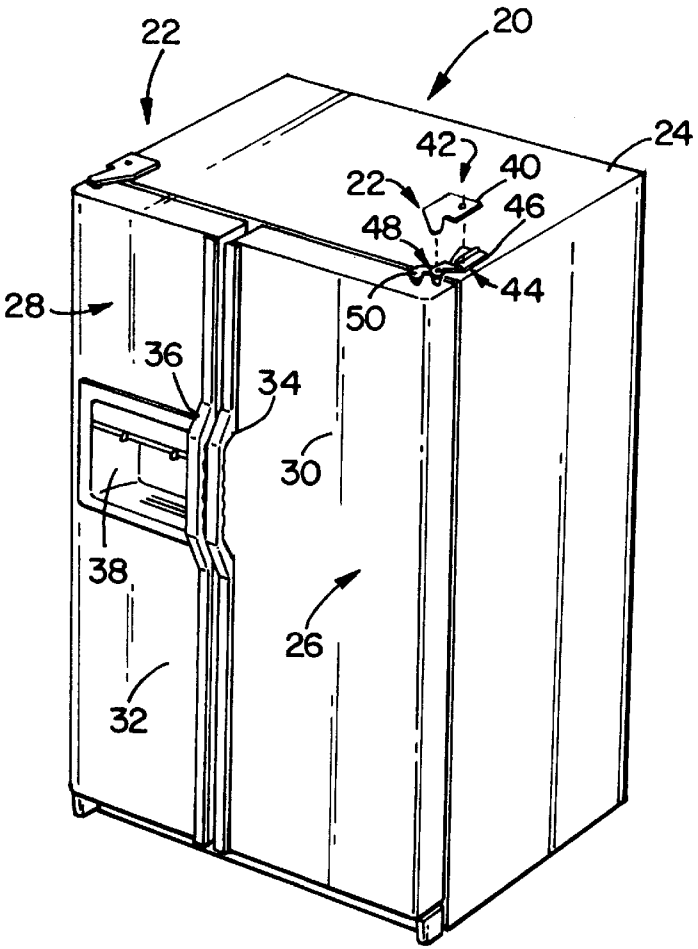
FIG. 1 is a perspective view of a side-by-side refrigerator including a door hinge and closure mechanism in accordance with one embodiment of the present invention.

Referring now specifically to the drawings, FIG. 1 is a perspective view of a side-by-side refrigerator 20 including hinge and closure mechanisms 22 (sometimes referred to herein as hinge mechanisms 22) in accordance with one embodiment of the present invention. Refrigerator 20 also includes a cabinet 24 having a fresh food storage compartment 26 and a freezer storage compartment 28 arranged in a side-by-side configuration. Each storage compartment 26 and 28 has a front access opening normally closed by a fresh food door 30 and a freezer door 32, respectively. Each door 30 and 32 is secured to compartment cabinet 24 by one of hinge mechanisms 22, and handles 34 and 36 are mounted to each door 30 and 32 to facilitate door opening. Freezer door 32 includes a through-the-door dispensing mechanism 38 for dispensing, for example, ice and water.

With respect to hinge mechanisms 22, a cover 40 is secured over each mechanism 22 by a screw 42. Each mechanism 22 includes a hinge unit 44 including a hinge plate 46 and a closure unit 48 including a pivot plate 50. Each hinge mechanism 22 is identical, and therefore the following description of one hinge mechanism 22 applies to the other hinge mechanism 22 mounted to cabinet 24.

Figure 2:
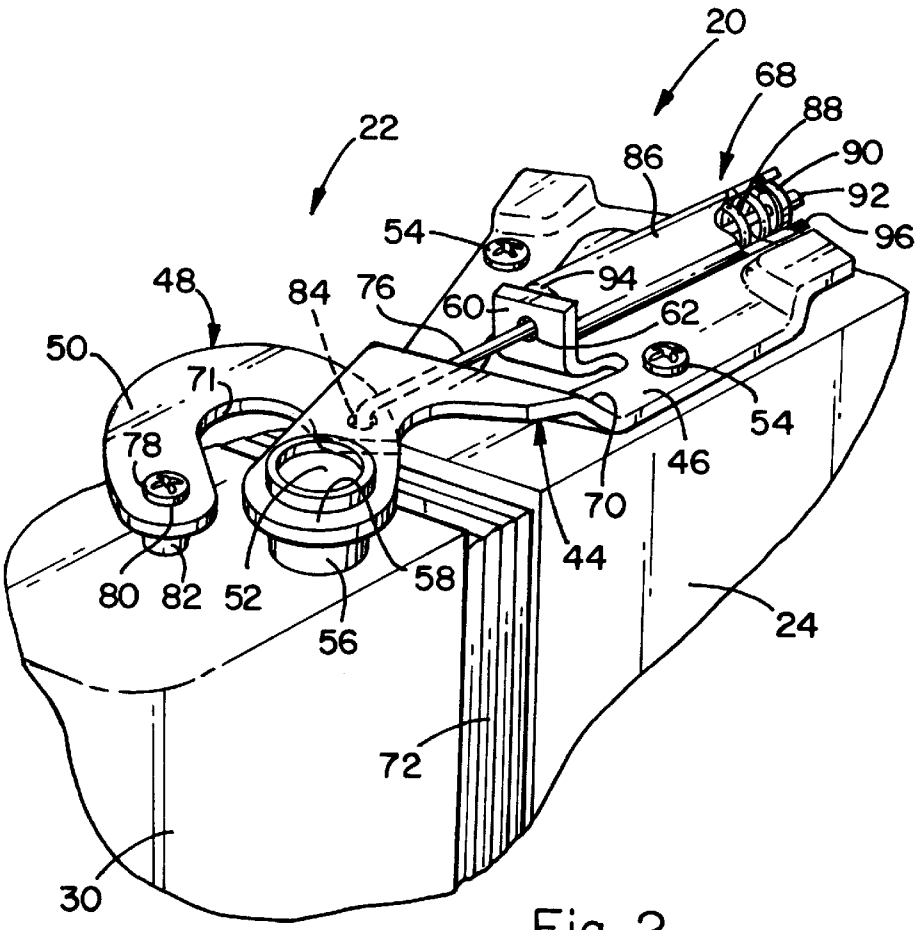
FIG. 2 is a perspective view of a portion of the refrigerator shown in FIG. 1 including the door hinge and closure mechanism.

Referring now to FIG. 2 which is a perspective view of a portion of refrigerator 20, and as explained above, door hinge and closure mechanism 22 includes a hinge unit 44 and a closure unit 48. Units 44 and 48 are integral in that hinge plate 46 of hinge unit 44 serves as a support for components of closure unit 48. More particularly, hinge plate 46 is mounted to door 30 and to cabinet 24. Hinge plate 46 is mounted to door 30 by a hinge pin 52, and hinge plate 46 is mounted to cabinet 24 by screws 54 which extend through openings in hinge plate 46 and into threaded engagement with cabinet 24. A bushing 56 extends through hinge pin opening 58 in hinge plate 46 and facilitates low friction movement of door 30 relative to hinge plate 46. Hinge plate 46 also includes a tab 60 having an opening 62 therethrough which, as described below in more detail, cooperates with components of closure unit 48. Hinge plate 46 also includes an offset portion 70 having a link slot (not shown in FIG. 1) therein. Hinge plate 64 extends over a door gasket 72.

As explained above, closure unit 48 includes a pivot plate 50 having a generally u-shape and spring assembly 68. Pivot plate 50 includes a slot 71 which cooperates with bushing 56 to provide deceleration forces when door 30 is opened beyond a first lock position. Spring assembly 68 is coupled to pivot plate 50 by a link 76. More particularly, pivot plate 50 is secured to door 30 by a screw 78 which extends through a first opening 80 in pivot plate 50. Screw 78 extends through a bore of a bushing 82 which is trapped between pivot plate 50 and door 30. Link 76 extends through a second opening 84 in pivot plate 50.

Closure unit 48 also includes spring assembly 68, which includes an elongate spring housing 86 and a compression spring 88 located within housing 86. Link 76 extends through spring 88 and a stop washer 90, and one end 92 of link 76 is crimped to prevent link 76 from being pulled through washer 90 towards door 30. Stop washer 90 therefore is trapped between spring 88 and crimped end 92 of link 76. A first end 94 of housing 86 is closed but includes an opening for link 76 and a second end 96 of housing 86 is open. First housing end 94 may be rounded and in contact with tab 60 which limits movement of housing 86 at least in a direction towards door 30. Housing 86 may, however, move angularly with respect to tab 60 depending upon the forces acting on spring assembly 68 due to the position of door 30.

Figure 3:
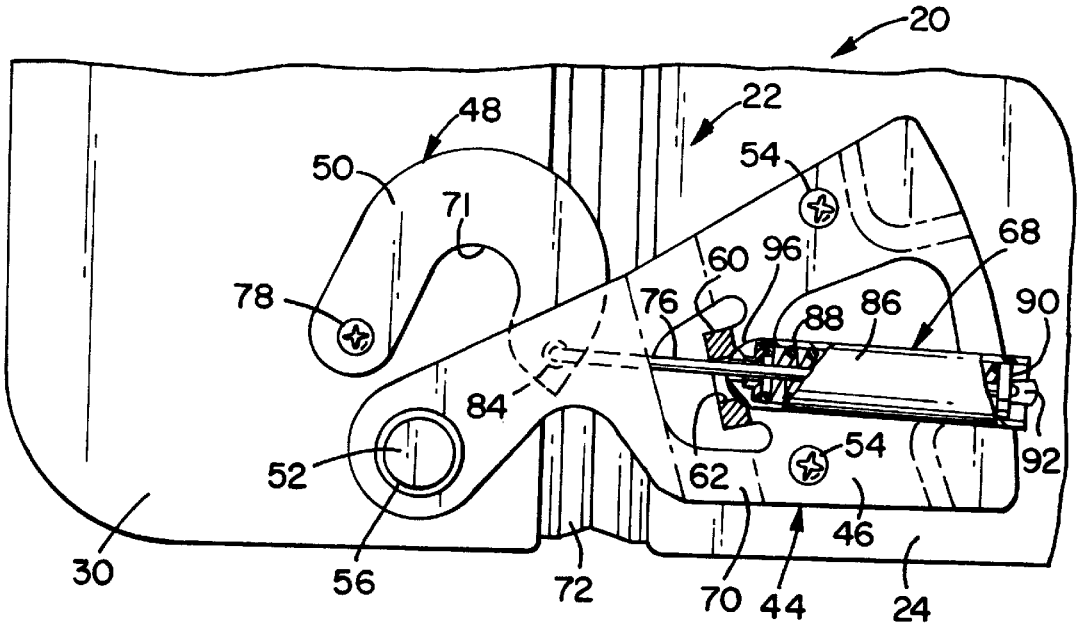
FIG. 3 is a top view of the door hinge and closure mechanism shown in FIG. 2.

FIG. 3 is a top view of door hinge and closure mechanism 22 shown in FIG. 2. The path of link 76, as shown in FIG. 2, extends from opening 84 in pivot plate 50, through offset 70 in hinge plate 46 and opening 62 in tab 60, and through spring 88. Crimped end 92 of link 76 and stop washer 90 prevent link 76 from separating from spring assembly 68.

Figure 4:
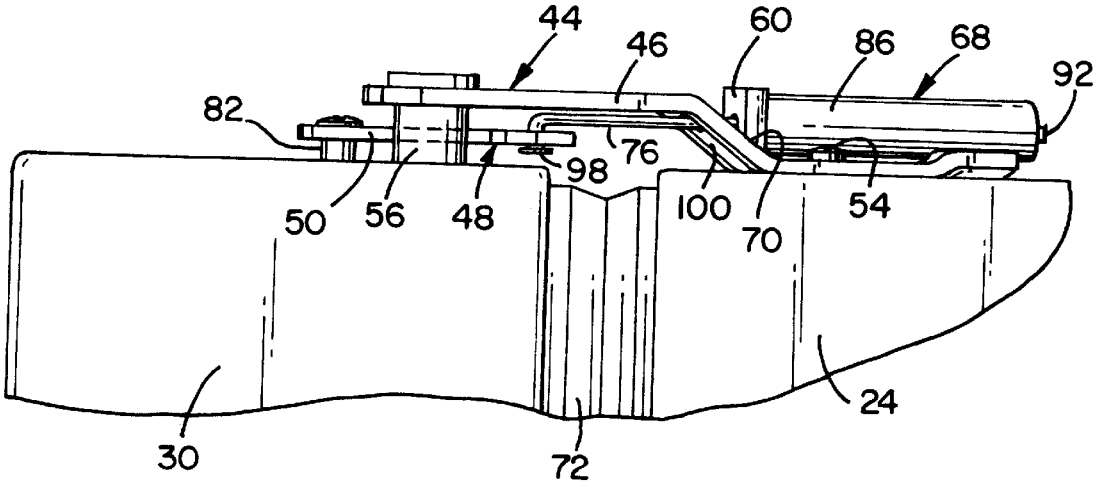
FIG. 4 is a side view of the door hinge and closure mechanism shown in FIG. 2.

FIG. 4 is a side view of door hinge and closure mechanism 22. As shown in FIG. 4, an end of link 76 is crimped to prevent link 76 from separating from pivot plate 50. Also, slot 100 in offset portion 70 through which link 76 extends is shown in FIG. 4.

Link 76 may be a flexible wire such as cable, and compression spring 88 may be fabricated from spring steel. Spring housing 86 may, for example, be fabricated from plastic. Hinge plate 46 and pivot plate 50 may be fabricated from 1045 carbon steel, for example. Of course, the components of mechanism 22 may be fabricated from many other materials.

In operation, closure unit 48 applies a pre-load force on door 30 when door 30 is in a closed position. The magnitude of the pre-load force depends upon the extent to which spring 88 is compressed when door 30 is in the closed position. Particularly, when door 30 is in the fully closed position, the compression of spring 88 is selected so that a closure force is applied to door 30 by pivot plate 50 via link 76.

As door 30 is opened toward a neutral, or "zero", force position, door 30 rotates relative to hinge plate 46 and spring 88 is progressively compressed by forces acting on link 76 from pivot plate 50. This compression of spring 88 causes a closure force to be applied to door 30 by pivot plate 50. Also, as door 30 is opened from the fully closed position, spring assembly 68 moves, or rotates, angularly relative to tab 60.

Figure 5:
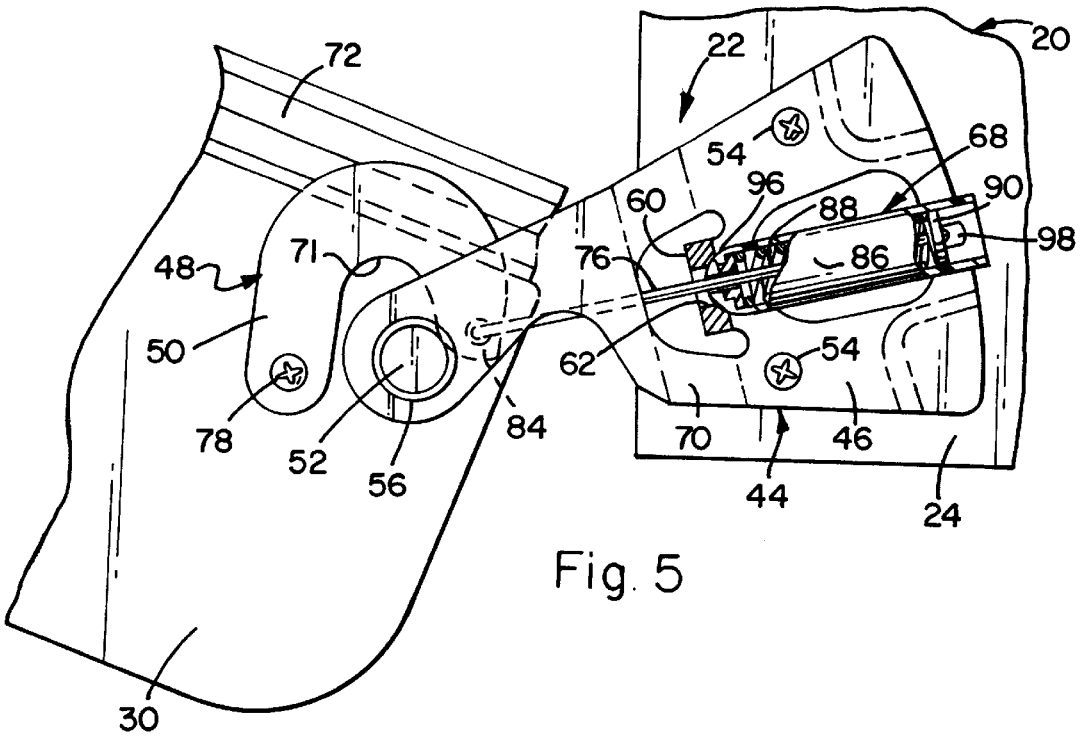
FIG. 5 is a top view of the door hinge and closure mechanism shown in FIG. 2 with the door opened to the neutral force position.

FIG. 5 is a top view of door hinge and closure mechanism 22 with door 30 opened to the neutral force position. In the neutral force position, spring housing 86 and spring 88 have rotated from the fully closed position (FIG. 3), and hinge pin 52, link 76, and spring 88 are substantially aligned. When hinge pin 52, link 76, and spring 88 are aligned as shown in FIG. 5, door 30 is not drawn either toward a more closed or more open position. In addition, in the neutral force position, a user may be able to use both hands to remove items from or place items in refrigerator 20.

Figure 6:
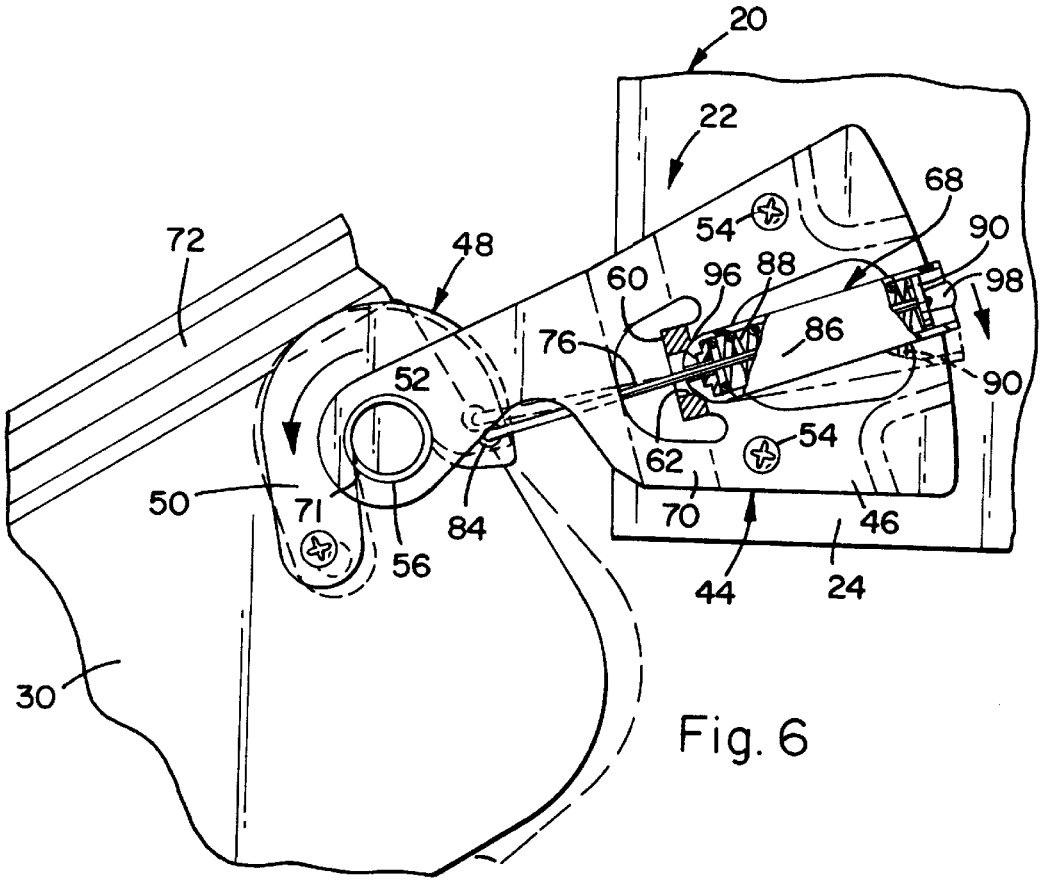
FIG. 6 is a top view of the door hinge and closure mechanism shown in FIG. 2 with the door opened to a first lock position.

FIG. 6 is a top view of door hinge and closure mechanism 22 with door 30 opened to a first lock position. Also shown in FIG. 6, in phantom, is door 30 opened to a full stop position. As door 30 is moved from the neutral force position shown in FIG. 5 to the first lock position shown in FIG. 6, spring housing 86 and spring 88 rotate further relative to tab 60 and spring 88 expands to reduce the forces on door 30. As a result, a user may easily open door 30 beyond the neutral force position to the first lock position. In the first lock position, however, bushing 56 is located in slot 71 and the friction forces between hinge plate 50 and bushing 56 act as a deterrent to further opening of door 30. As the user rotates door 30 to an even more open position such as the full stop position shown in phantom in FIG. 6, spring 88 is progressively compressed and generates greater forces to resist such further opening. The compression of spring 88 and the friction forces between bushing 56 and hinge plate 50 deter such opening.

Rather than being expanded when door 30 is opened from the fully closed position to the neutral force position, as with known spring closure mechanisms, spring 88 of closure unit 48 is compressed. Compressing spring 88 is believed to result in a more smooth and constant closure force on door 30, as well as extending the useful life of spring 88. Further, a single screw 78 mounts hinge and closure mechanism 22 to door 30, which facilitates easy assembly and removal of door 30 from cabinet 24. Also, no component of mechanism 22 is mounted internally within door 30. Rather, all components of mechanism 22 are mounted externally of door, which facilitates avoiding energy loss due to the location of metal parts within door 30. Mechanism 22 also provides sufficient closure force so that designed-in rear tilt of cabinet 24 is unnecessary to ensure proper closure of door 30.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

I claim:

1. A refrigerator comprising a cabinet having at least one access opening closed by a door, said door coupled to said cabinet by a hinge and closure mechanism, said mechanism comprising:

a hinge unit comprising a hinge plate mounted to said door and to said cabinet; and a closure unit comprising a pivot plate mounted to said door, a spring coupled to said hinge plate so that said spring moves angularly with respect thereto as said door moves between a fully closed position and a fully open position, and a link coupling said spring to said pivot plate.

2. A refrigerator in accordance with claim 1 wherein said hinge unit further comprises a hinge pin for mounting said hinge plate to said door, and a plurality of screws for mounting said hinge plate to said cabinet.

3. A refrigerator in accordance with claim 1 wherein said hinge plate comprises a tab for limiting movement of said spring.

4. A refrigerator in accordance with claim 1 wherein said closure unit further comprises a screw for mounting said pivot plate to said door, and said pivot plate comprises a first opening and a second opening, said screw extending through said pivot plate first opening and said link extending through said pivot plate second opening.

5. A refrigerator in accordance with claim 1 wherein said closure unit further comprises an elongate spring housing, said spring positioned within said spring housing, and said link extending at least partially through said housing.

6. A refrigerator in accordance with claim 5 wherein said closure unit further comprises a stop washer, said link extending through said stop washer and one end of said link is crimped, said stop washer trapped between said spring and said crimped end of said link.

7. A refrigerator in accordance with claim 5 wherein said hinge plate comprises a tab having an opening therein, said link extending through said tab opening, and one end of said elongate spring housing in contact with and movable relative to said tab.

8. A refrigerator in accordance with claim 1 wherein said link comprises a cable.

9. A refrigerator in accordance with claim 1 wherein said closure unit is configured to apply a pre-load force on said door when said door is in a closed position.

10. A refrigerator in accordance with claim 1 wherein said closure unit is configured to apply a substantially constant closure force to said door when said door is between a closed position and a neutral force position.

11. A refrigerator in accordance with claim 10 wherein said closure unit is configured apply a resisting force to said door when said door is opened beyond said neutral force position.

12. An integrated door hinge and closure mechanism for being mounted to a refrigerator, the refrigerator including a cabinet having at least one access opening closed by a door, said hinge and closure mechanism configured to couple the door to the cabinet, said mechanism comprising:

a hinge unit comprising a hinge plate configured to be mounted to the door and to the cabinet; and a closure unit comprising a pivot plate configured to be mounted to the door, a spring coupled to said hinge plate so that said spring moves angularly with respect thereto as said door moves between a fully closed position and a fully open position, and a link coupling said spring to said pivot plate.

13. An integrated door hinge and closure mechanism in accordance with claim 12 wherein said hinge unit further comprises a hinge pin for mounting said hinge plate to the door, and a plurality of screws for mounting said hinge plate to the cabinet.

14. An integrated door hinge and closure mechanism in accordance with claim 12 wherein said closure unit further comprises a screw for mounting said pivot plate to the door, and said pivot plate comprises a first opening and a second opening, said screw configured to extend through said pivot plate first opening and said link extending through said pivot plate second opening.

15. An integrated door hinge and closure mechanism in accordance with claim 12 wherein said closure unit further comprises an elongate spring housing, said spring positioned within said spring housing, and said link extending at least partially through said housing.

16. An integrated door hinge and closure mechanism in accordance with claim 15 wherein said closure unit further comprises a stop washer, said link extending through said stop washer and one end of said link is crimped, said stop washer trapped between said spring and said crimped end of said link.

17. An integrated door hinge and closure mechanism in accordance with claim 15 wherein said hinge plate comprises a tab having an opening therein, said link extending through said tab opening, and one end of said elongate spring housing in contact with and movable relative to said tab.

18. A door hinge and closure mechanism for being mounted to a refrigerator, the refrigerator including a cabinet having at least one access opening closed by a door, said hinge and closure mechanism configured to coupled the door to the cabinet, said mechanism comprising:

a hinge unit comprising a hinge plate configured to be mounted to the door and to the cabinet, said hinge plate comprising a tab having a opening therein, and a hinge pin for mounting said hinge plate to the door; and a closure unit comprising a pivot plate configured to be mounted to the door, a spring movably coupled to said hinge plate, a link coupling said spring to said pivot plate, an elongate spring housing, said spring positioned within said spring housing, and said link extending at least partially through said housing, said link further extending through said tab opening, and one end of said elongate spring housing in contact with and movable relative to said tab.

19. A door hinge and closure mechanism in accordance with claim 18 herein said closure unit further comprises a stop washer, said link extending through said stop washer and one end of said link is crimped, said stop washer trapped between said spring and said crimped end of said link.

* * * * *